US009879634B2

(12) United States Patent
Lavazza et al.

(10) Patent No.: US 9,879,634 B2
(45) Date of Patent: Jan. 30, 2018

(54) ENGINE BLOCK FOR AN INTERNAL COMBUSTION ENGINE

(71) Applicant: GM GLOBAL TECHNOLOGY OPERATIONS LLC, Detroit, MI (US)

(72) Inventors: Paolo Lavazza, Turin (IT); Silvio Domenico Mosso, Rivoli (IT); Krzysztof Adam Fijak, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 54 days.

(21) Appl. No.: 14/743,406

(22) Filed: Jun. 18, 2015

(65) Prior Publication Data

US 2015/0369111 A1 Dec. 24, 2015

(30) Foreign Application Priority Data

Jun. 18, 2014 (GB) ..... 1410858.3

(51) Int. Cl.
*F02F 1/14* (2006.01)

(52) U.S. Cl.
CPC ..... *F02F 1/14* (2013.01)

(58) Field of Classification Search
CPC ..... F02F 1/14
USPC ..... 123/41.79
See application file for complete search history.

(56) References Cited

U.S. PATENT DOCUMENTS

| | | | | |
|---|---|---|---|---|
| 2,456,951 A | 12/1948 | Klotsch | | |
| 4,672,923 A * | 6/1987 | Wahnschaffe | F02F 1/14 | 123/195 R |
| 5,988,120 A * | 11/1999 | Betsch | F02F 1/10 | 123/41.74 |
| 2009/0194046 A1* | 8/2009 | Shikida | F02F 1/14 | 123/41.74 |
| 2009/0266315 A1* | 10/2009 | Hanai | F02F 1/16 | 123/41.72 |
| 2010/0242868 A1* | 9/2010 | Shikida | F01P 3/02 | 123/41.79 |
| 2012/0204821 A1* | 8/2012 | Tofukuji | F02F 1/14 | 123/41.79 |

FOREIGN PATENT DOCUMENTS

| | | |
|---|---|---|
| FR | 2905422 A1 | 3/2008 |
| JP | 2011106387 A | 6/2011 |

OTHER PUBLICATIONS

Great Britain Patent Office, Great Britain Search Report for Great Britain Application No. 1410858.3, dated Dec. 10, 2014.

* cited by examiner

*Primary Examiner* — Joseph Dallo
*Assistant Examiner* — Yi-Kai Wang
(74) *Attorney, Agent, or Firm* — Lorenz & Kopf, LLP

(57) ABSTRACT

An engine block for an internal combustion engine including a cylinder coolant channel provided with a coolant inlet conduit. The coolant inlet includes a baffle for dividing the coolant inlet conduit into two passageways both in communication with the cylinder coolant channel.

12 Claims, 11 Drawing Sheets

ENGINE BLOCK FOR AN INTERNAL COMBUSTION ENGINE

CROSS-REFERENCE TO RELATED APPLICATION

This application claims priority to Great Britain Patent Application No. 1410858.3, filed Jun. 18, 2014, which is incorporated herein by reference in its entirety.

TECHNICAL FIELD

The present disclosure pertains to an engine block tier an internal combustion engine, and more particularly to a cylinder cooling channel realized in the engine block.

BACKGROUND

An internal combustion engine includes an engine block defining at least one cylinder having a piston coupled to rotate a crankshaft. A cylinder head cooperates with the piston to define a combustion chamber. A fuel and air mixture is disposed in the combustion chamber and ignited, resulting in hot expanding exhaust gasses causing reciprocal movement of the piston. The fuel is provided by at least one fuel injector and the air through at least one intake port, located on an intake side of the cylinder head. The exhaust gasses, on the contrary, are expelled, through at least an exhaust port, located on an exhaust side of the cylinder head opposite to the intake side.

The heat generated by the fuel combustion is partly dissipated by a cooling system, which includes a coolant pump that circulates a coolant, typically a mixture of water and antifreeze, through a cylinder cooling channel, realized in the engine block. The cylinder cooling channel surrounds the engine cylinder and it is in fluid communication with a corresponding cylinder head coolant channel realized in the cylinder head. The coolant exiting from these coolant channels is directed towards a radiator, where the coolant exchanges the heat, received from the engine, with the air of the ambient environment, before returning in the coolant pump.

The cylinder coolant channel includes a single inlet so that the coolant, which flows through the inlet, freely splits in a first part which flows through a first tract of the coolant channel, located on an intake side of the cylinder head, and in a second tract which flows through a second portion of the coolant channel, located on an exhaust side of the cylinder head. The fact that the coolant freely splits in two parts is a drawback of this configuration because it determines a not balanced coolant circulation in the cylinder coolant channel.

Indeed, it has been observed that most of the coolant circulates near the bottom of the cylinder coolant channel and that the speed of the coolant is not uniform in the channel being very high in proximity of the bottom of the channel. The high speed of the coolant causes a cavitation phenomenon at the coolant inlet, while a non-uniform speed of the coolant determines a different coolant effect on the cylinder, which can lead to damage of the engine due to the distortion of a cylinder wall and consequent seizing of the associated piston.

In addition, other objects, desirable features and characteristics will become apparent from the subsequent summary and detailed description, and the appended claims, taken in conjunction with the accompanying drawings and this background.

SUMMARY

In accordance with the present disclosure, an engine block is described which provides a balanced circulation of the coolant in a simple, rational and rather inexpensive solution while avoiding the cited above drawbacks of the prior art. More particularly, an embodiment of the present disclosure includes an engine block for an internal combustion engine having a cylinder coolant channel provided with a coolant inlet conduit. The coolant inlet conduit includes a baffle for dividing the coolant inlet conduit into two passageways both in communication with the cylinder coolant channel. As a result, the coolant entering the coolant inlet does not freely split into two parts but it is divided by the baffle into two determined quantity guaranteeing that a more uniform circulation of the coolant in the coolant channel.

According to an aspect of the present disclosure, one passageway has a section larger than the other passageway. In this way, it is possible to differentiate the quantity of coolant flowing through each passageway allowing a more balanced circulation of the coolant in the coolant channel.

According to another aspect of the present disclosure, the passageway, having a larger section, is in fluid connection with a first tract of the coolant channel, located on an intake side of an engine head, while the smaller passageway is in fluid connection with a second tract of the coolant channel, located on an exhaust side of the engine head. As a result, it is possible to obtain a more uniform cool off of the cylinders of the engine improving the engine cooling system.

According to another aspect of the present disclosure, the inlet conduit includes a lower wall having an inclined surface configured to direct the coolant towards an upper wall of the coolant inlet conduit. This aspect of the present disclosure facilitates the entrance of the coolant in the coolant channel improving the coolant circulation.

According to another aspect of the present disclosure, the engine block includes an upper space in fluid communication with the coolant inlet conduit and with the cylinder coolant channel. In this way, a portion of the coolant enters the upper space where it is directed towards the coolant channel improving the distribution and the circulation of the coolant near the cylinder head.

According to a further aspect of the present disclosure, the upper space includes a deflector defining two ducts both in communication with the cylinder coolant channel. This aspect of the present disclosure improves the circulation of the coolant near the cylinder head, According to another aspect of the present disclosure, the upper space communicates with the coolant inlet conduit via an opening provided in an upper wall of the inlet conduit. This aspect of the present disclosure has the advantage to be an inexpensive solution for realizing a fluid communication between the coolant inlet conduit and the upper space.

Another embodiment of the present disclosure provides that the upper space communicates with the coolant inlet conduit via an opening provided in the baffle. This aspect of the present disclosure has the advantage to guarantee an improved coolant flow in the upper space.

Another embodiment of the present disclosure provides that the baffle is oriented parallel to a cylinder central axis. This aspect of the present disclosure guarantees a solution for splitting the coolant flow.

Another embodiment provides for an internal combustion engine including an engine block having on or more of the technical aspects disclosed above. This embodiment of the present disclosure has substantially the same advantages disclosed in the previous embodiments.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the application and uses of the invention. Furthermore, there is no intention to be bound by any theory presented in the preceding background of the invention or the following detailed description.

Figure 1:
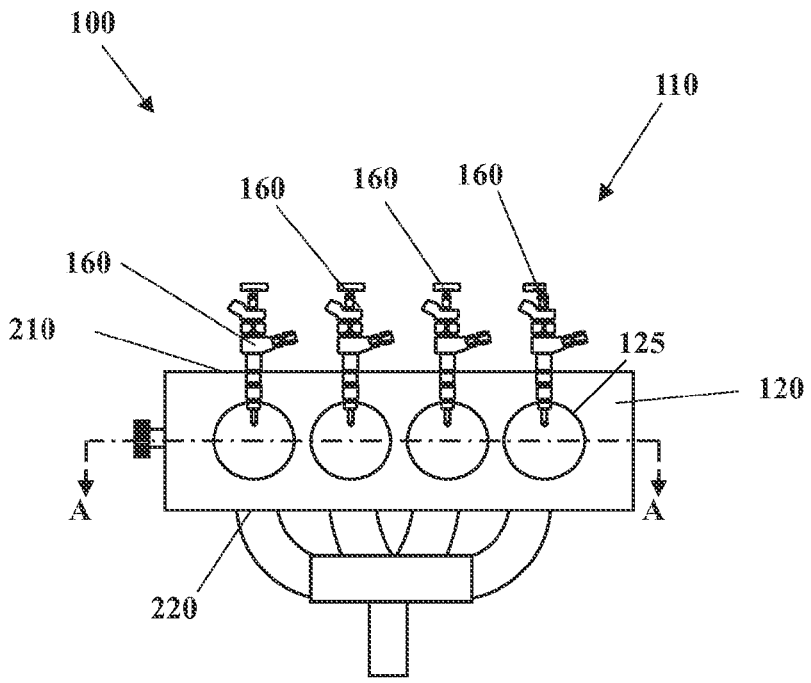
FIG. 1 schematically shows an automotive system according to an embodiment of the present disclosure.
Figure 2:
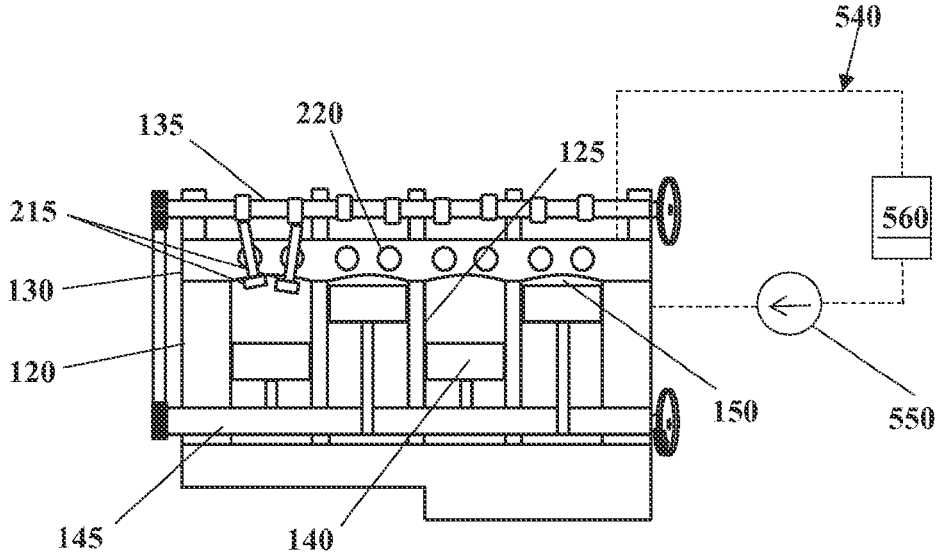
FIG. 2 is the section A-A of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220.

Figure 3:
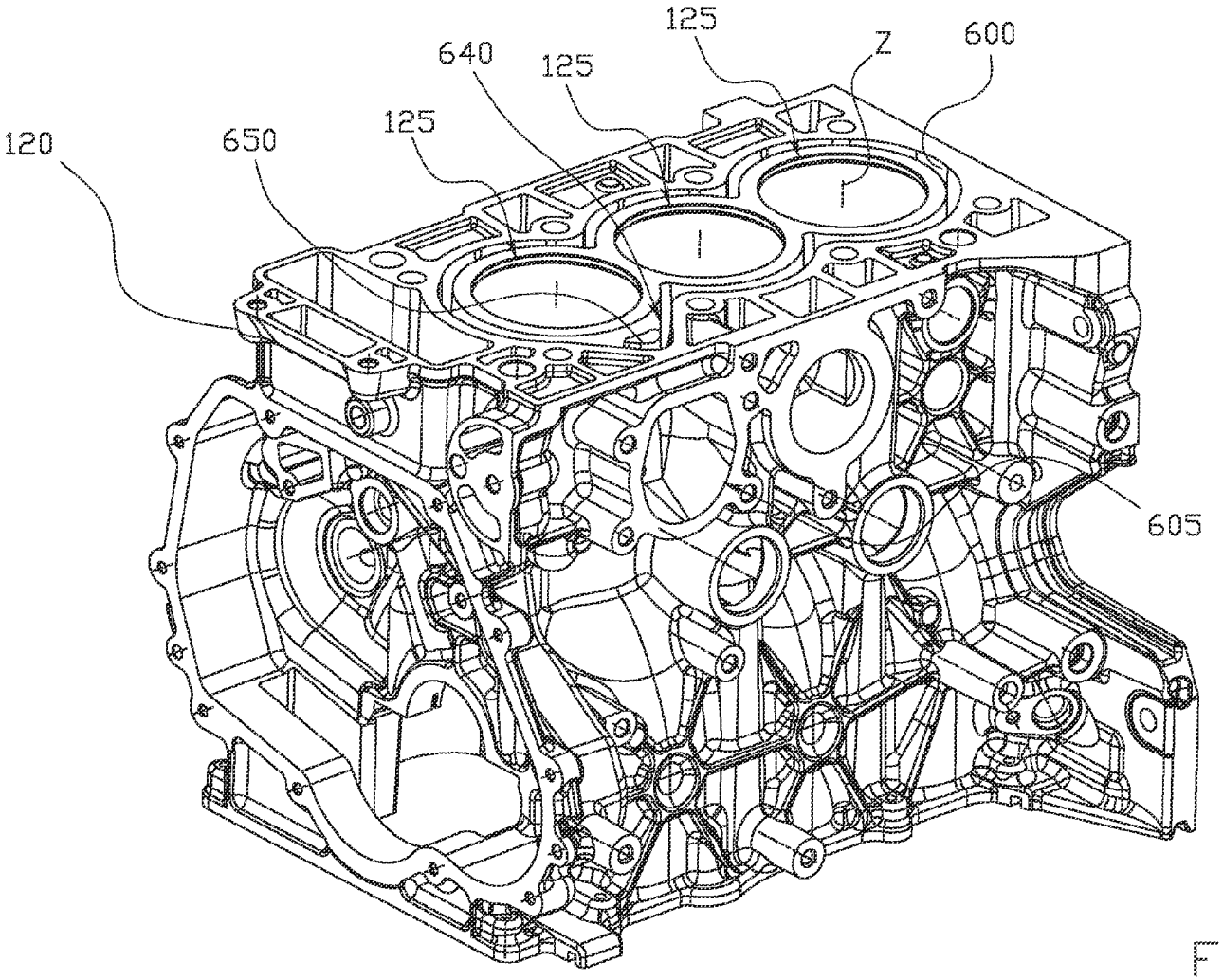
FIGS. 3 is a prospective view of an engine block according to a first embodiment of the present disclosure.

The internal combustion engine (ICE) 110 is also provided with a cooling system 540 (FIG. 2) including a coolant pump 550 which circulates a coolant, typically a mixture of water and antifreeze, through a cylinder cooling channel 600, realized in the engine block 120 (FIG. 3). According to an embodiment shown in FIG. 3, the cylinder coolant channel 600 is an annular channel surroundings the cylinders 125 defined by the engine block 125, and it includes a coolant inlet conduit 605 realized in the engine block 125 and a coolant outlet conduit, not shown, realized in the cylinder head 130 (FIG. 2). The coolant exiting from the cylinder cooling channel 600 is directed towards a radiator 560, where the coolant exchanges the heat, received from the engine, with the air of the ambient environment, before returning to the coolant pump 550.

Figure 6:
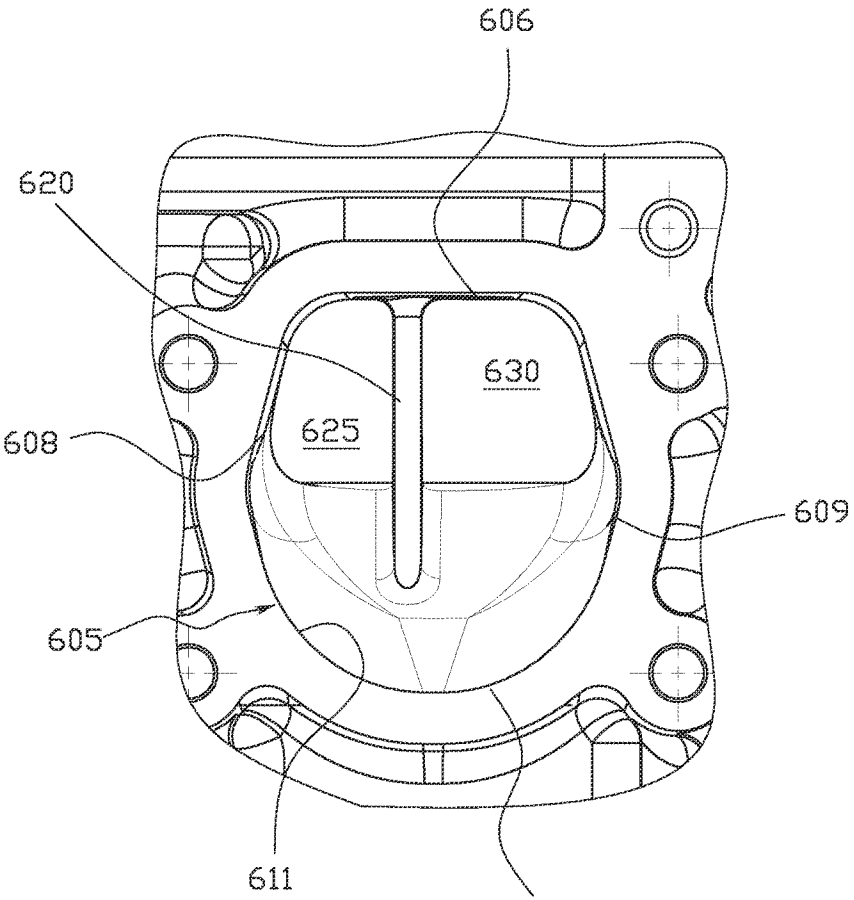
FIG. 6 is an enlarged portion of a view from A in FIG. 4.

The coolant inlet conduit 605 of the cylinder coolant channel 600 is defined (FIG. 6) by an upper and a bottom wall 606 and 607 having ends respectively connected together by two lateral walls 608 and 609. The walls 606, 607, 608, and 609 define an inlet aperture 611 of the inlet conduit 605 which is made by casting, on a lateral side, of the engine block 120. The coolant inlet conduit 605 includes also a baffle 620 for dividing the inlet conduit 605 into two passageways 625 and 630 both in communication with the cylinder coolant channel 600.

According to an aspect of this embodiment the baffle 620 is oriented parallel to a cylinder central axis Z; however, a different embodiment, can provide that the baffle is inclined with respect to the central axis Z of the cylinder. According to this embodiment of the present disclosure the passageway 630, in section, is larger than the passageway 625, in section, so that the coolant quantity flowing through the passageway 630 is greater than the coolant quantity flowing through the passageway 625.

Figure 4:
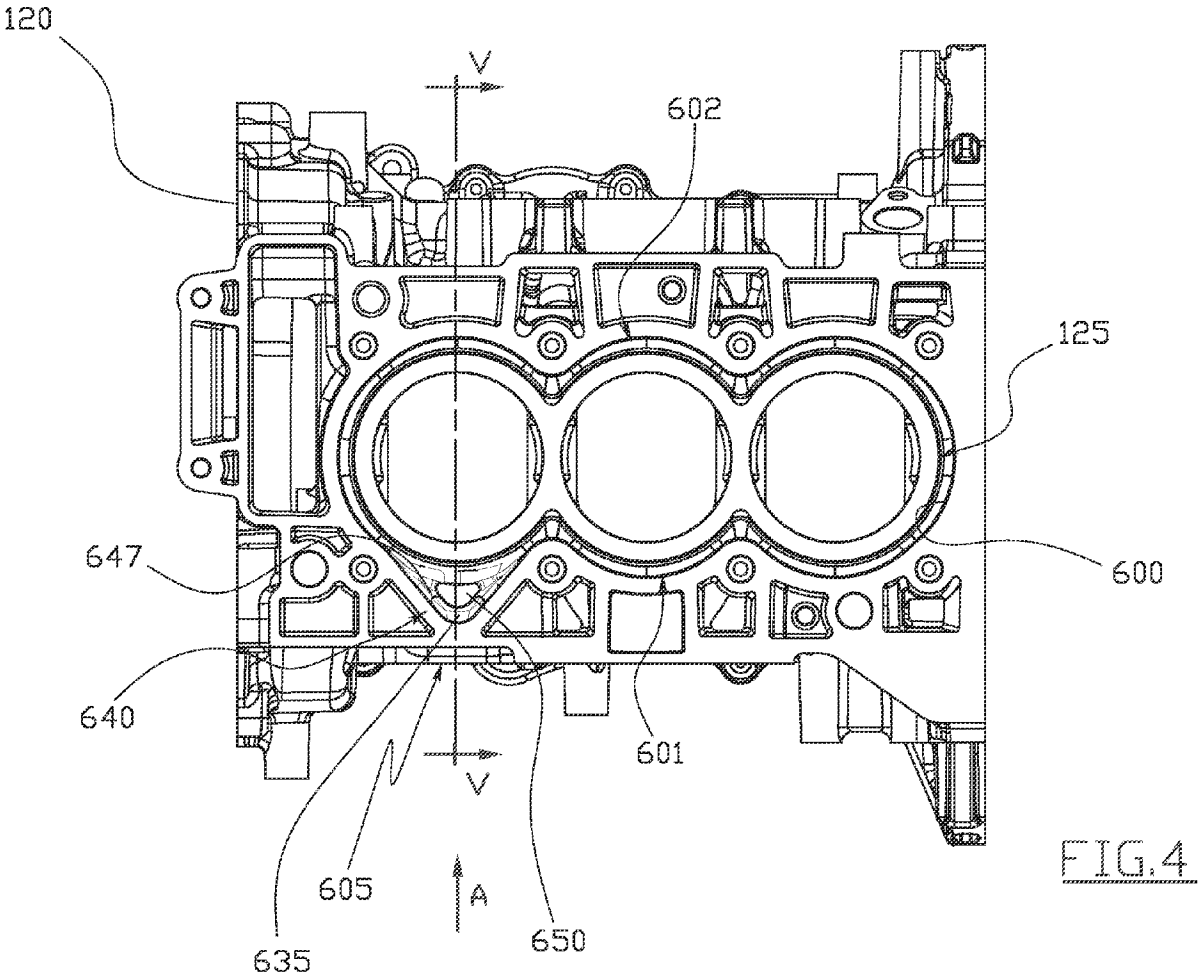
FIG. 4 is a top-view of FIG. 3.
Figure 9:
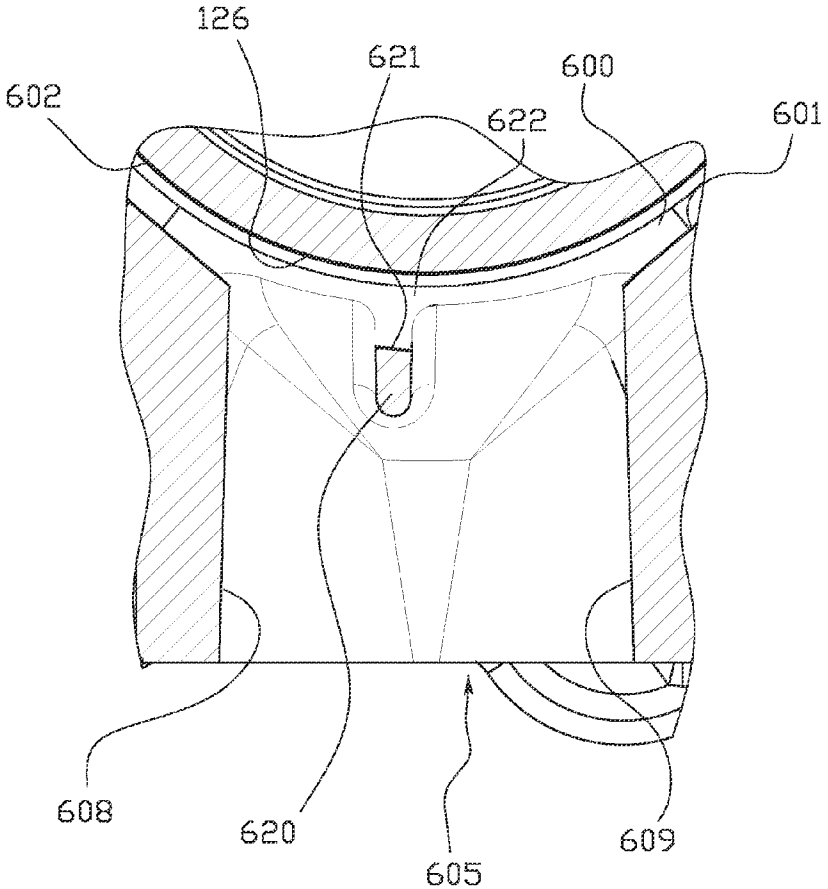
FIG. 9 is a view of section IX-IX of FIG. 5.
Figure 8:
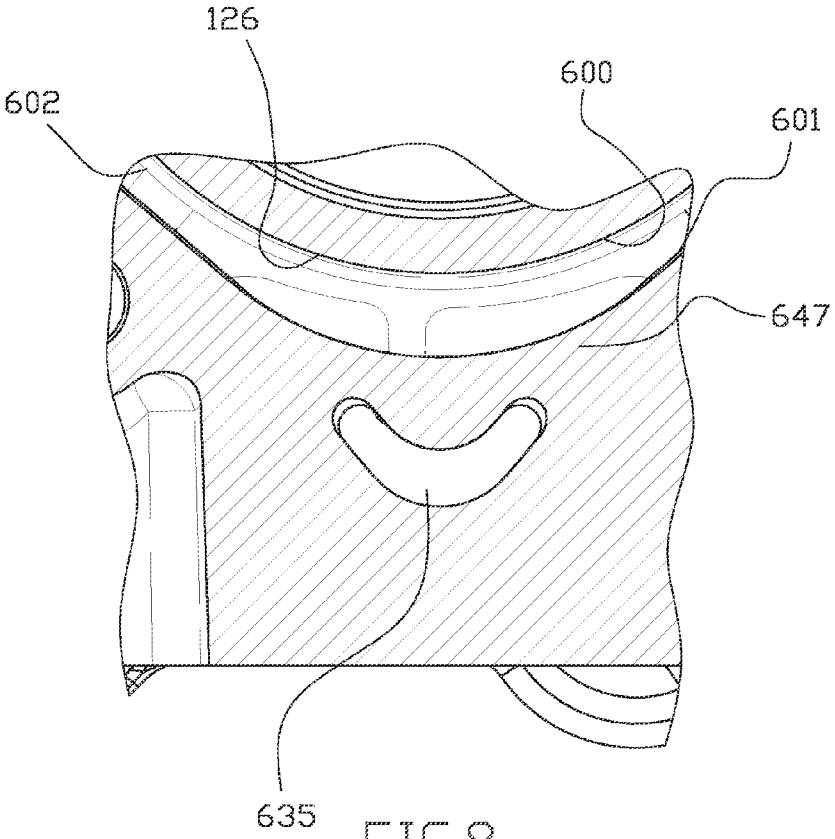
FIG. 8 is a view of section of FIG. 5.
Figure 10:
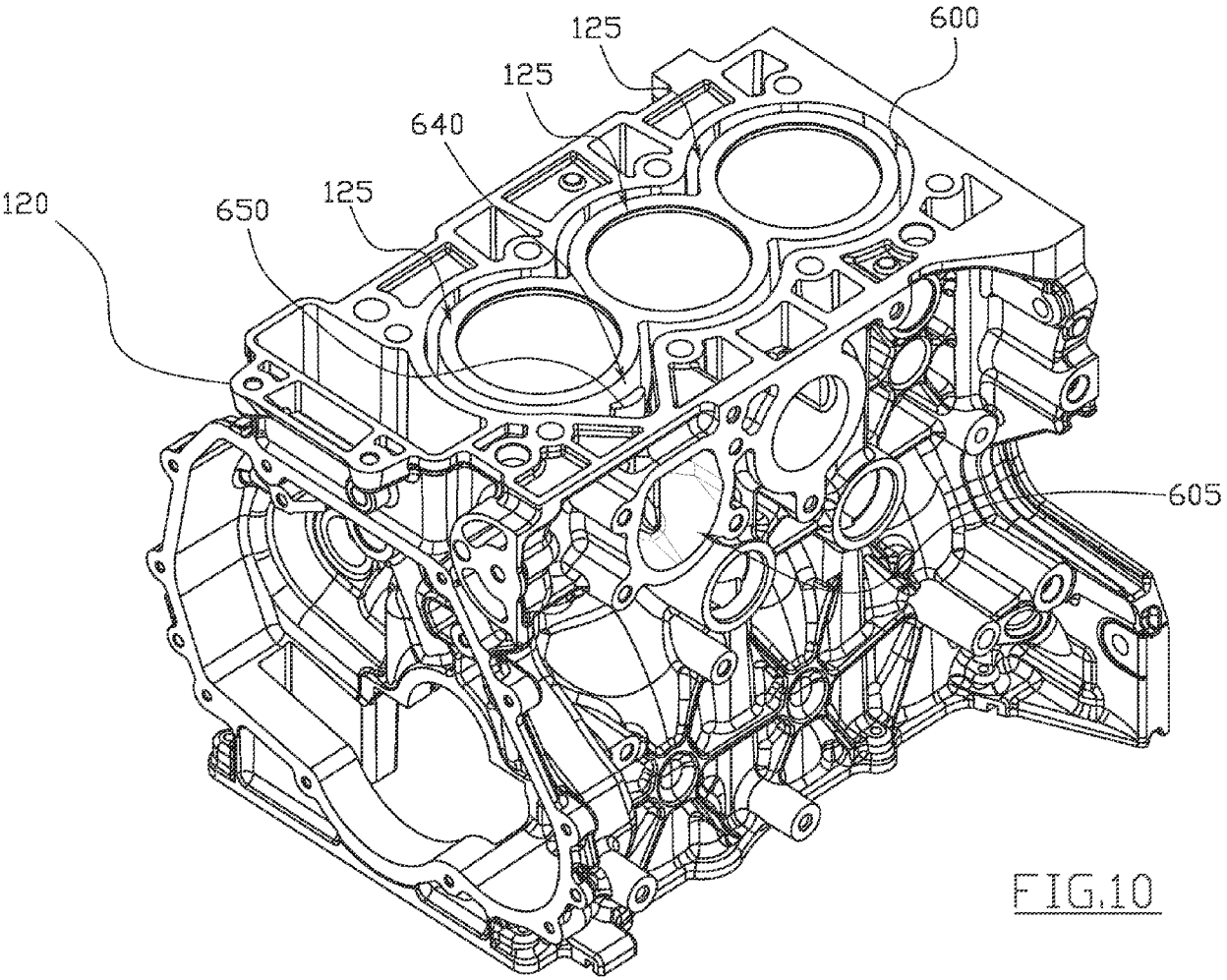
FIG. 10 is a prospective view of an engine block according to a second embodiment of the present disclosure.
Figure 11:
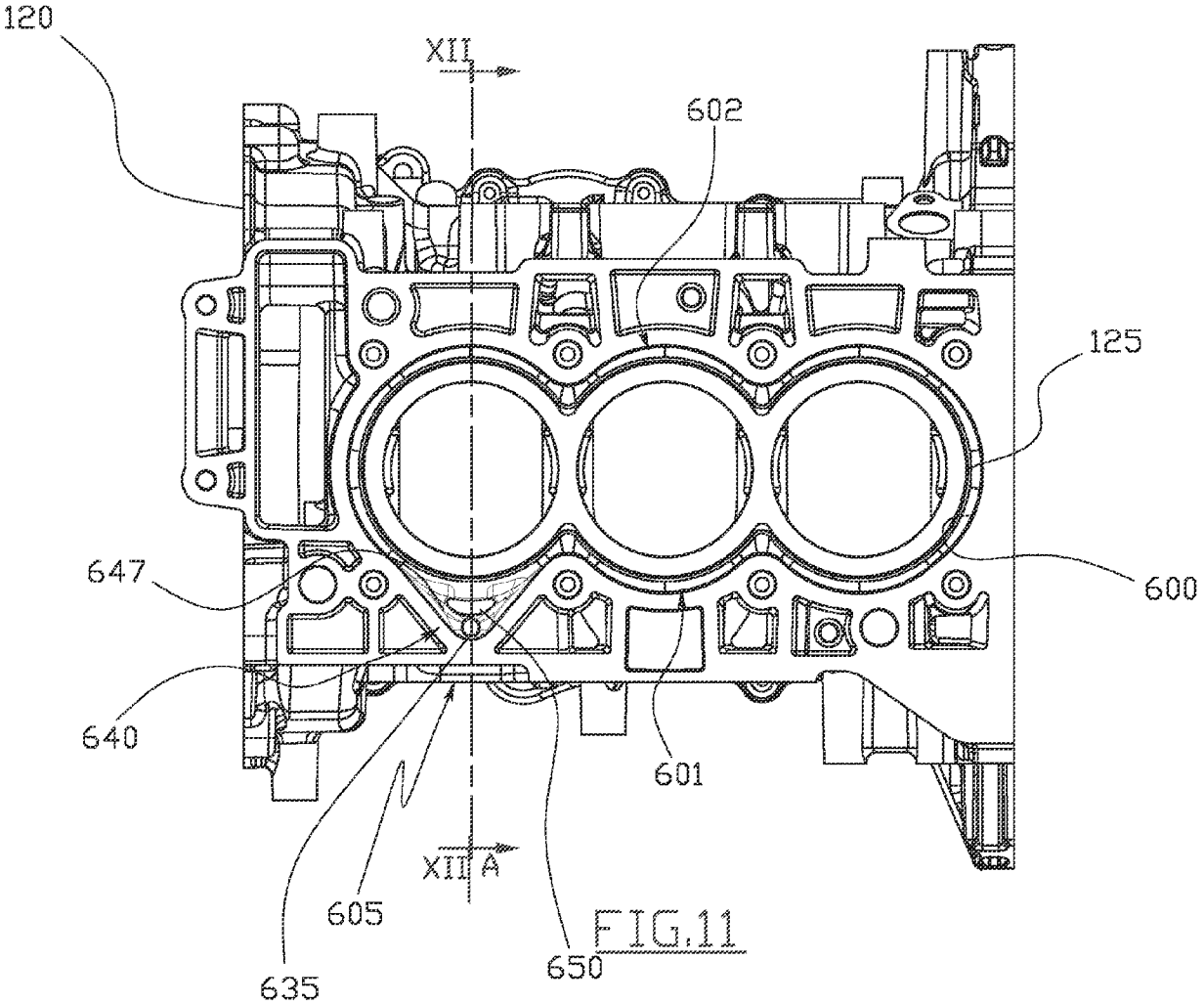
FIG. 11 is a top-view of FIG. 10.
Figure 12:
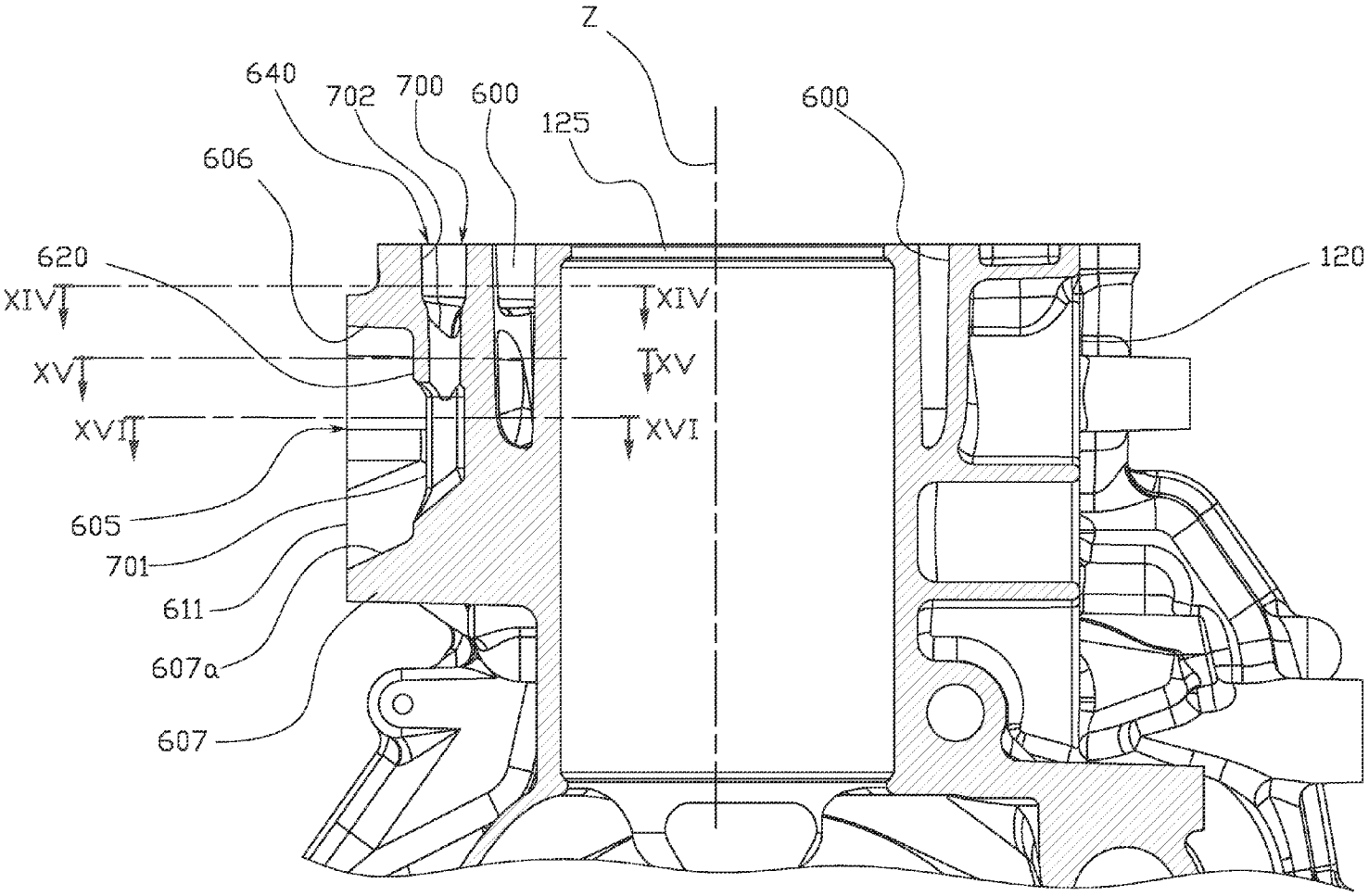
FIG. 12 is a view of section XII-XII of FIG. 11.
Figure 14:
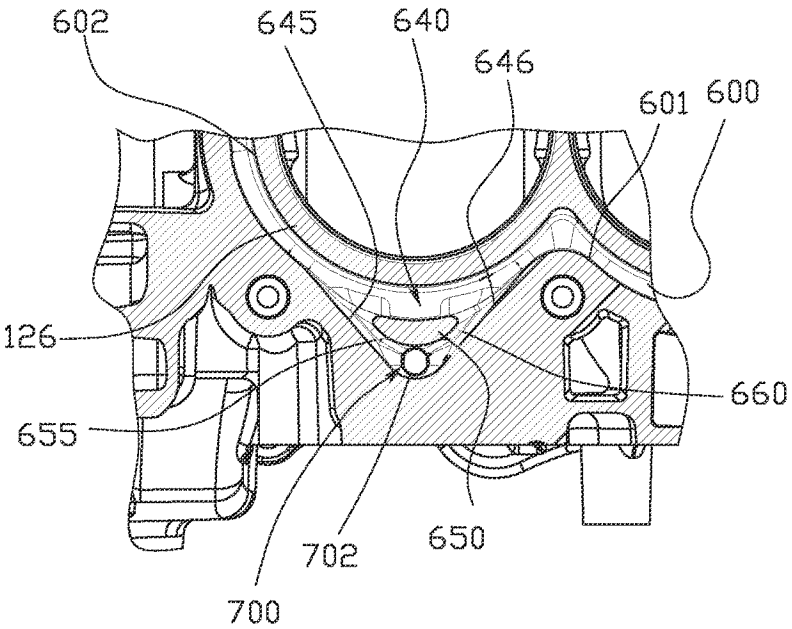
FIG. 14 is a view of section XIV-XIV of FIG. 12.
Figure 13:
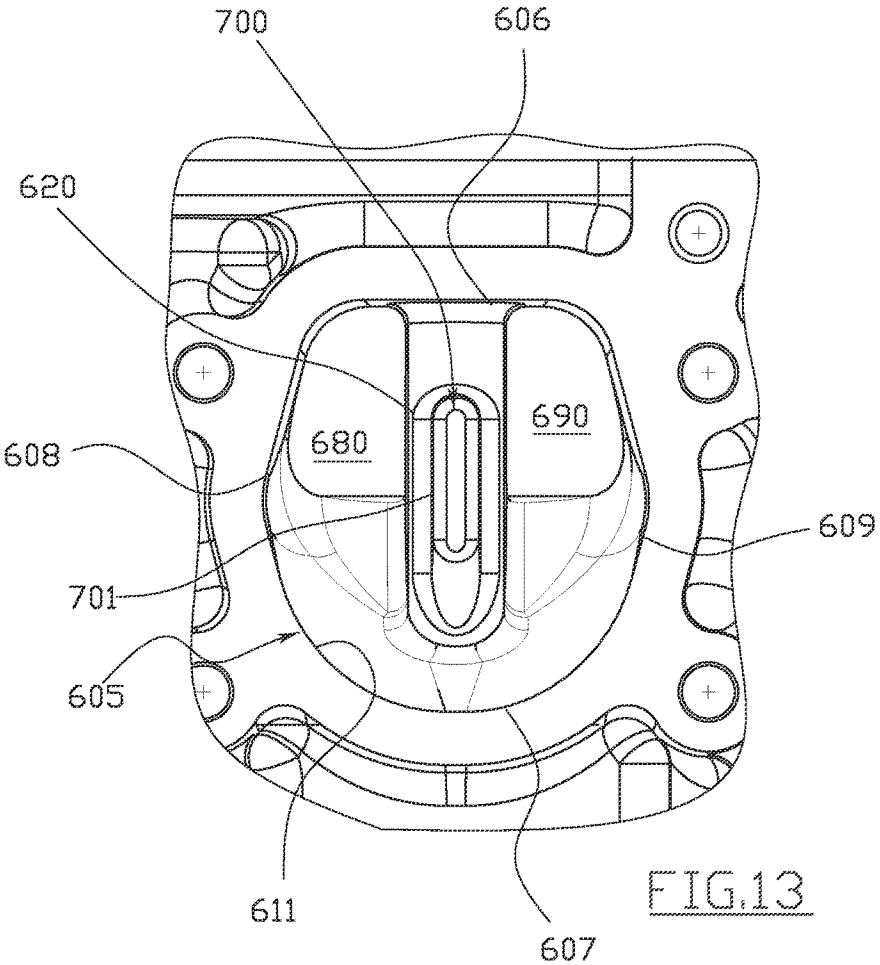
FIG. 13 is an enlarged portion of a view from B in FIG. 11.

In detail, the passageway 630 is in fluid communication with a tract 601 (FIG. 4) of the coolant channel 600 which surrounds a side of the cylinders 125 corresponding to an intake side of the cylinder head where the intake ports 210 are located. On the contrary, the passageway 625 is in fluid communication with a tract 602 of the coolant channel 600 which surrounds a side of the cylinders 125 corresponding to an exhaust side of the cylinder head 130, opposite to the intake side, where the exhaust ports 220 are located. The baffle 620 has a rear wall 621 (FIG. 9) which is spaced apart from a wall 126 of the cylinder 125 creating a passage 622 for the coolant allowing a better cooling of the cylinder 125.

Figure 5:
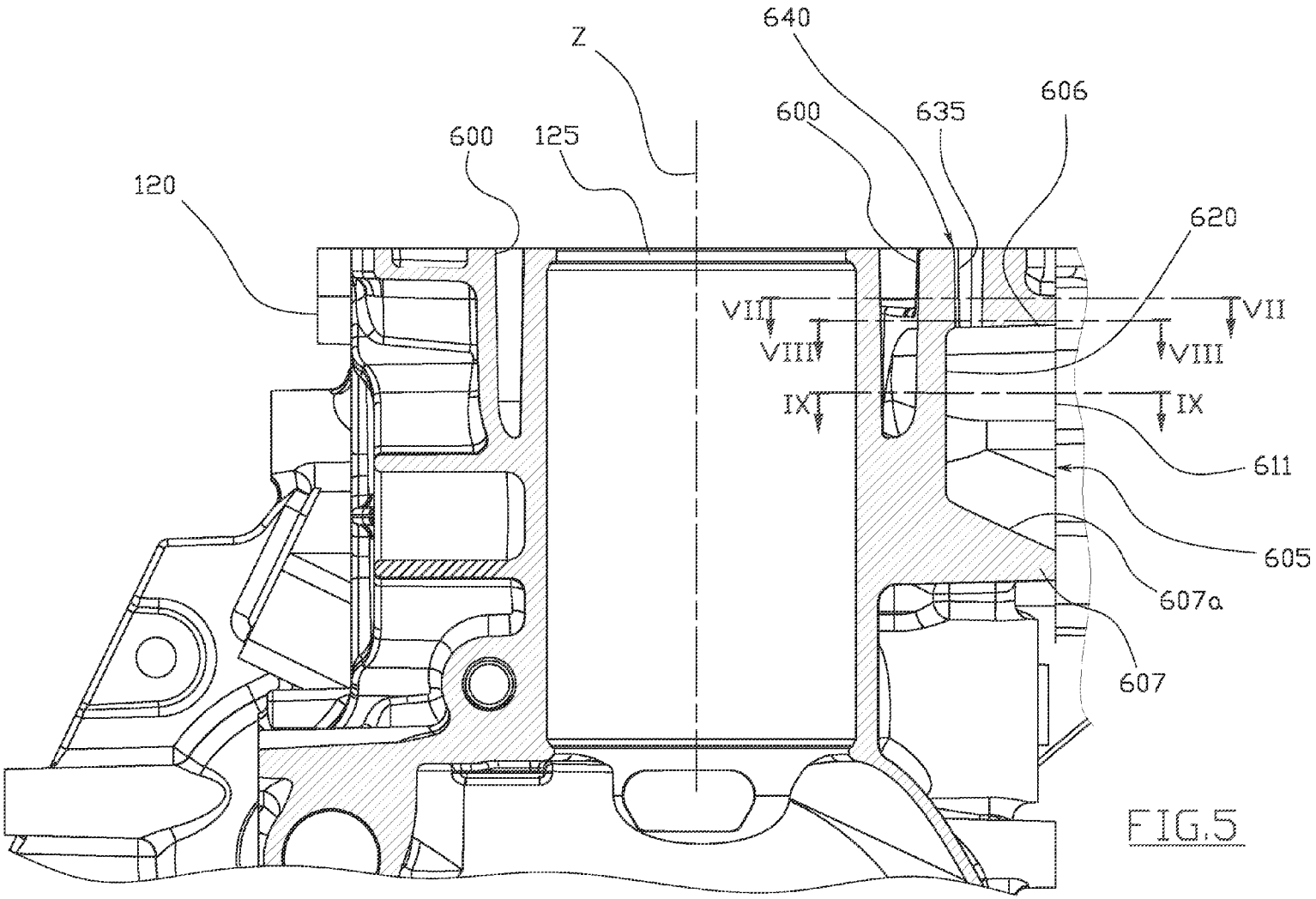
FIG. 5 is a view of section V-V of FIG. 4.
Figure 7:
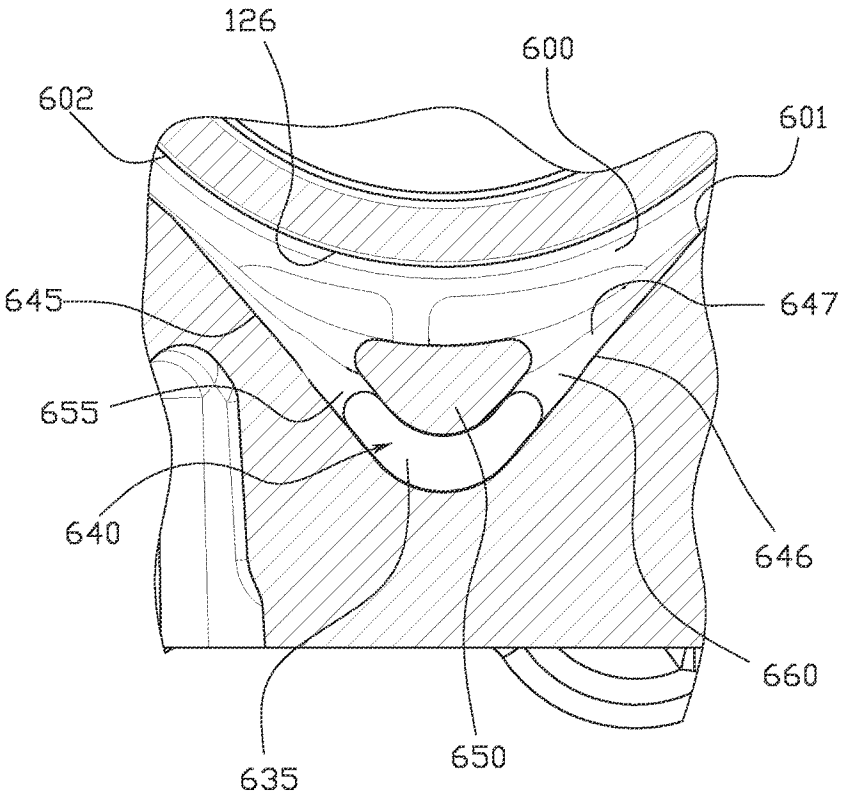
FIG. 7 is a view of section of FIG. 5.

FIG. 5 shows that the bottom wall 607 has an inclined surface 607*a*, with respect to a horizontal plane, which starting from the inlet aperture 611 rise up inside the inlet conduit 605. The inclined surface 607*a* has the function to direct the coolant flow up towards the upper wall 606, which is provided with a through opening 635, having a bean shape, which put in fluid communication the inlet conduit 605 with an upper space 640 (FIG. 7), located above and adjacent to the coolant inlet conduit 605.

The upper space 640 is in fluid communication with the inlet conduit 605 and with the cylinder coolant channel 600. The upper space 640 is defined by two lateral walls 645, 646 connected at a common end, and by a portion of a cylinder wall 126 and by a bottom wall 647 adjacent to the upper wall 606. The upper space 640 includes a shaped deflector 650 which defines, together with the lateral walls 645 and 646, and the bottom wall 647, two ducts 655,660, each respectively in communication with a tract 602, 601 of the coolant channel 600. The through opening 635 is located between the shaped deflector 650 and the common end of the two lateral walls 645 and 646, so that the coolant flow, entering the upper space 640 through the opening 635, is divided and it flows through the two ducts 655 and 660 in fluid communication with the coolant channel 600, in detail respectively with the tracts 601 and 602 of the coolant channel 600.

The two ducts 655 and 660 are dimensioned and shaped for imparting a tangential direction to the flow of coolant so to direct the coolant flow near the cylinder head 130. In this way, a first portion of the coolant flow entering in the coolant inlet conduit 605 is divided by the baffle 620 and directed through the passageways 625, 630 and a second portion is directed towards the upper space 640 where is divided by the deflector 650 and directed, through the ducts 655 and 660, to the coolant channel 600. This configuration allows a balanced coolant circulation in the coolant channel 600 improving the cooling system of the engine.

According to this embodiment, the passageways 625 and 630 are dimensioned so that the 55% of the flow of coolant flows through the larger passageway 630, while the 35% of the flow of coolant flows through the smaller passageway 625, while the 10% of the flow of coolant flows throughout the opening 635 in the upper chamber 640.

A different embodiment provides that the upper wall 606 does not have an opening 635 and, therefore, an upper space 640 is not present. In this case, the coolant flow, entering in the coolant inlet conduit 605, is divided by the baffle 620 and directed through the passageways 625, 630. The passageways 625 and 630 are, in this case, dimensioned so that the 60% of the flow of coolant flows through the larger passageway 630, while the 40% of the flow of coolant flows through the smaller passageway 625.

Figure 15:
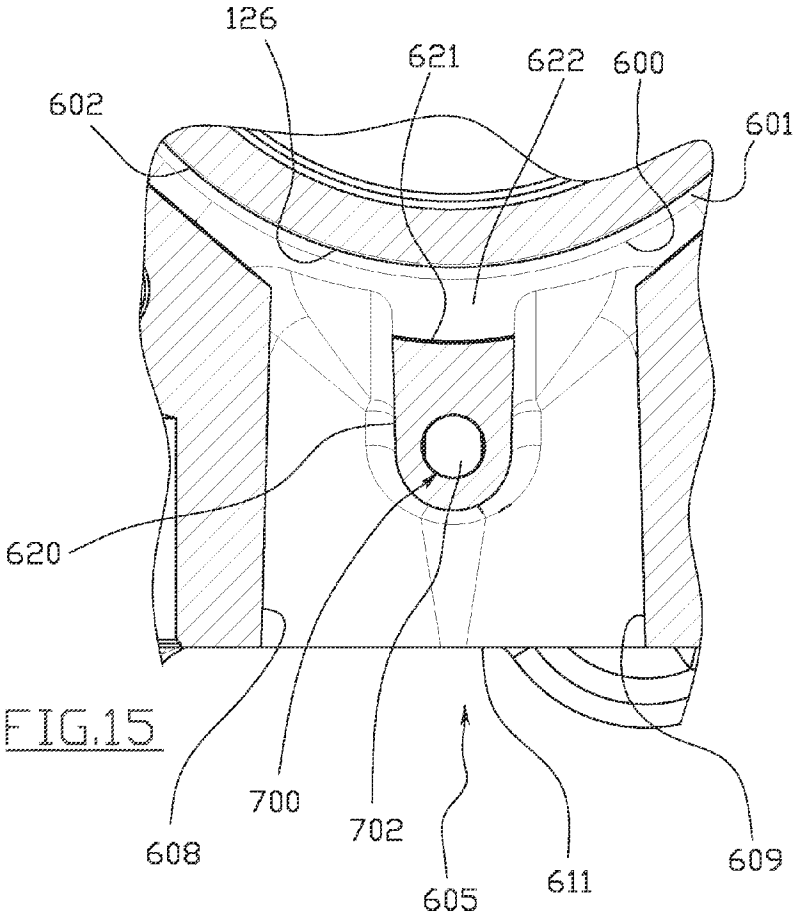
FIG. 15 is a view of section XV-XV of FIGS. 12.

FIGS. 10-16 show an alternate embodiment of the present disclosure which differs from the previously described embodiments. It is emphasized that in the disclosure of the alternate embodiment of the present disclosure the elements, identical to the ones previously described are marked with the same reference numbers. The main difference, between this alternate embodiment and the already disclosed embodiment, is that the opening 635, which, in the first embodiment, puts in fluid communication the coolant inlet conduit 605 with the upper chamber 640, is realized as an opening 700 extending through the baffle 620 (FIG. 15).

Figure 16:
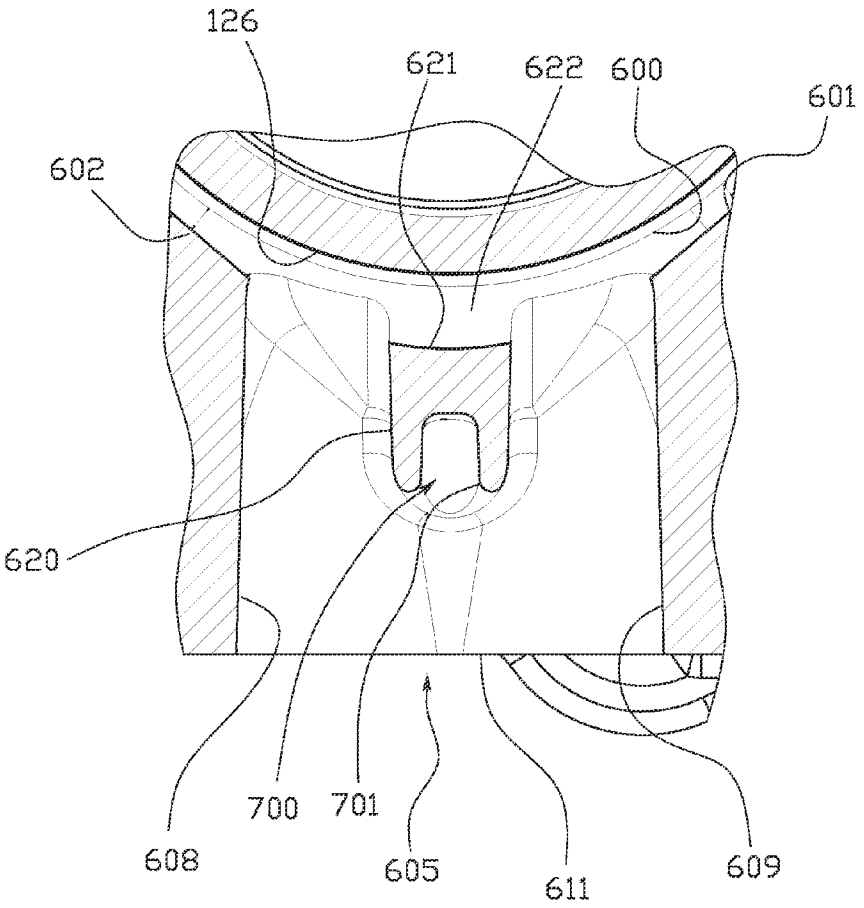
FIG. 16 is a view of section XVI-XVI of FIG. 12.

In detail, the opening 700 has the shape of a channel having an elongated end 701 on a frontal surface of the baffle 620 and a circular end 702 on the upper wall 606 (FIG. 16). According to the alternate embodiment, the baffle 620 divides the inlet conduit 605 into two passageways 680, 690 (FIG. 13) both in communication with the cylinder coolant channel 600. The passageway 680 has, in section, the same dimensions of the passageway 690 so that the same coolant quantity flows through both the passageway 680 and 690. In detail, the passageway 690 is in fluid communication with a tract 601 of the coolant channel 600 which surrounds a side of the cylinders 125 corresponding to on an intake side of the cylinder head where the intake ports 210 are located. On the contrary, the passageway 680 is in fluid communication with a tract 602 of the coolant channel 600 which surrounds a side of the cylinders 125 corresponding to on an exhaust side of the cylinder head 130, opposite to the intake side, where the exhaust ports (not shown) are located.

According to this embodiment the baffle 620 has a rear wall 621 which is spaced apart from a wall 126 of the cylinder 125 creating a passage 622 for the coolant allowing a better cool off of the cylinder 125. The baffle is oriented parallel to a cylinder central axis Z; however, a different embodiment, can provide that the baffle is inclined with respect to the central axis Z of the cylinder. Apart of the disclosed differences between the first and the second embodiment, the remaining technical features, including the several different aspects, are common to both the embodiments.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An engine block having an intake side, an exhaust side and an upper surface configured to accommodate a cylinder head for an internal combustion engine comprising:

a cylinder wall defining at least one cylinder therein;

a cylinder coolant channel surrounding the cylinder wall;

a coolant inlet conduit having a baffle dividing the coolant inlet conduit into a first passageway and a second passageway, both passageways being in fluid communication with the cylinder coolant channel, and an upper space in fluid communication with the cylinder coolant channel, the upper space defined by a lateral wall opposite a portion of the cylinder wall, a bottom wall adjacent the coolant inlet conduit and the upper surface, the bottom wall having an opening formed therethrough such that the upper space is in fluid communication with the coolant inlet conduit, wherein the baffle has a channel formed therein terminating at the opening provided in the bottom wall of the upper space.

2. The engine block according to claim 1, wherein the first passageway has a section larger than the second passageway.

3. The engine block according to claim 2, wherein the cylinder coolant channel further comprises a first tract located on the intake side and in fluid communication with the first passageway, and a second tract located on the exhaust side and in fluid communication with the second passageway.

4. The engine block according to claim 1, wherein the coolant inlet conduit comprises an inclined surface configured to direct coolant towards the opening formed through the bottom wall of the upper space.

5. The engine block according to claim 1, wherein the baffle is oriented parallel to a cylinder central axis.

6. The engine block according to claim 1, wherein the upper space comprises a deflector defining a pair of ducts, each in fluid communication with the cylinder coolant channel.

7. An internal combustion engine comprising an engine block according to claim 1.

8. An engine block having an intake side, an exhaust side and an upper surface configured to accommodate a cylinder head for an internal combustion engine comprising:

a coolant inlet conduit having a baffle dividing the coolant inlet conduit into a first passageway and a second passageway, wherein the first passageway has a section larger than the second passageway; and a cylinder coolant channel including a first tract located on the intake side in fluid communication with the first passageway, a second tract located on the exhaust side in fluid communication with the second passageway, and an upper space between an upper wall of the coolant inlet conduit and the upper surface in fluid communication with the coolant inlet conduit and with the first and second tracts of the cylinder coolant channel;

wherein the upper space is in fluid communication with the coolant inlet conduit via an opening provided in an upper wall of the inlet conduit.

9. The engine block according to claim 8, wherein the upper space comprises a deflector defining a pair of ducts, each in fluid communication with the cylinder coolant channel.

10. An engine block having an intake side, an exhaust side and an upper surface configured to accommodate a cylinder head for an internal combustion engine comprising:

a coolant inlet conduit having a baffle dividing the coolant inlet conduit into a first passageway and a second passageway, wherein the first passageway has a section larger than the second passageway; and a cylinder coolant channel including a first tract located on the intake side in fluid communication with the first passageway, a second tract located on the exhaust side in fluid communication with the second passageway, and an upper space between an upper wall of the coolant inlet conduit and the upper surface in fluid communication with the coolant inlet conduit and with the first and second tracts of the cylinder coolant channel;

wherein the baffle has a channel formed therein which is in fluid communication with the upper space via an opening provided in the upper wall of the coolant inlet conduit.

11. The engine block according to claim 8, wherein the baffle is oriented parallel to a cylinder central axis.

12. The engine block according to claim 1, wherein the upper space comprises a deflector disposed between the lateral wall and the portion of the cylinder wall, wherein the opening is formed through the bottom wall between the lateral wall and the deflector.

* * * * *